United States Patent [19]

Hubatka

[11] 4,304,015

[45] Dec. 8, 1981

[54] PNEUMATIC ACTUATING DEVICE FOR A TOILET FLUSH VALVE

[75] Inventor: Alex Hubatka, St. Gallenkappel, Switzerland

[73] Assignee: Geberit AG, Jona, Switzerland

[21] Appl. No.: 156,236

[22] Filed: Jul. 3, 1980

[30] Foreign Application Priority Data

Jun. 5, 1979 [CH] Switzerland ..... 5223/79

[51] Int. Cl.[3] ..... E03D 5/04

[52] U.S. Cl. ..... 4/407; 4/408; 4/249; 4/308; 4/361

[58] Field of Search ..... 4/407, 408, 249, 406, 4/361, 328, 308, 423

[56] References Cited

U.S. PATENT DOCUMENTS

| | | | |
|---|---|---|---|
| 2,632,180 | 3/1953 | Pegler | 4/407 X |
| 2,760,204 | 8/1956 | Joanis | 4/249 X |
| 3,662,408 | 5/1972 | Knudtson | 4/407 |
| 3,987,501 | 10/1976 | Anderson | 4/407 X |
| 3,994,029 | 11/1976 | Badders | 4/407 X |
| 4,149,283 | 4/1979 | Knudtson | 4/249 X |

*Primary Examiner*—Henry K. Artis

*Attorney, Agent, or Firm*—Pollock, Vande Sande & Priddy

[57] ABSTRACT

A pneumatic actuating device for a toilet flush valve, comprising a cap emplaced on the flush valve housing and having an integral hemispherical bell member extending laterally therefrom, the bell member containing a resilient membrane. A manual pusher provided with a similar hemispherical membrane is connected to the bell member by a hose. A pipe which carries the flush valve plate is connected to a hood having a piston which extends into the membrane in the bell member. Upon actuation of the manual pusher, air flows through the hose, deforming the membrane in the bell member and causing it to lift the piston, thereby opening the flush valve.

4 Claims, 3 Drawing Figures

PNEUMATIC ACTUATING DEVICE FOR A TOILET FLUSH VALVE

SUMMARY OF THE INVENTION

The present invention relates to a pneumatic actuating device for a toilet flush valve.

BACKGROUND OF THE INVENTION

Toilet flush valves are normally actuated mechanically, by means of a lever system. Remote actuation by means of cable pulls is also known in the art. An electromagnetic actuating device is disclosed in Swiss Pat. No. 505,262; this device requires connection to a source of electricity and does not function during outages. An hydraulic actuating device for a drain valve is disclosed in Swiss Pat. No. 366,506; this requires the additional connection of an hydraulic main in order to actuate the cylinder connected to the drain valve.

It is an object of the present invention to provide a pneumatic actuating device for a flush valve, which device is readily attachable to existing flush valves, is simple and economical to manufacture from plastic material, and works independently of supplementary power supply.

BRIEF INTRODUCTION TO THE DRAWINGS

In order that the invention may be more clearly understood, reference will now be made to the accompanying drawings, wherein several embodiments of the invention are shown for purposes of illustration, and wherein.

DESCRIPTION OF A PREFERRED EMBODIMENT

Figure 1:
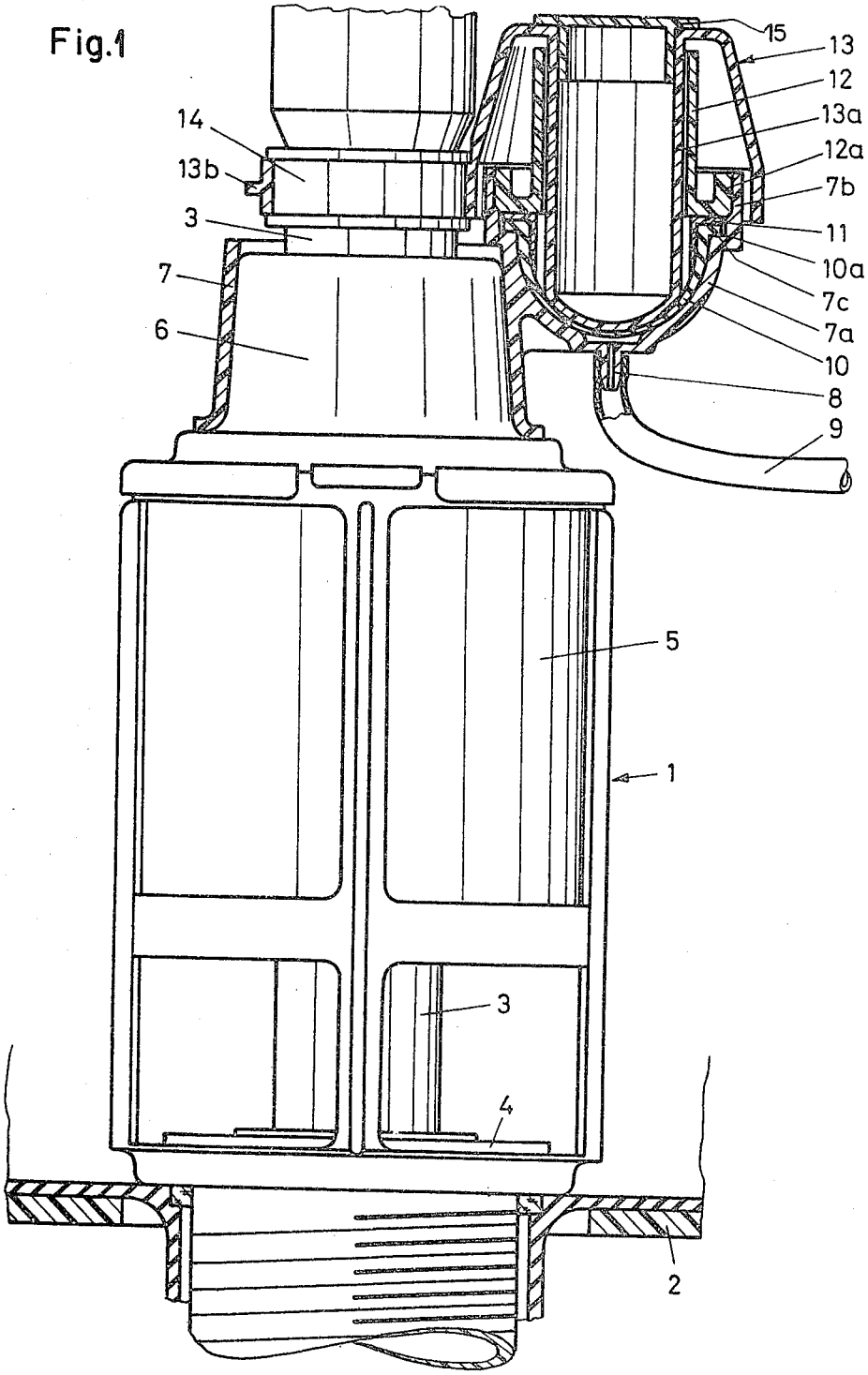
FIG. 1 is a front elevation of a flush valve with attached pneumatic actuating device shown in section.

FIG. 1 shows a flush valve 1, known per se, built into a flush tank 2. Its construction is described in detail in Swiss Pat. No. 443,172. When pipe 3 is lifted, valve plate 4 attached thereto frees the drain opening. By means of a float (not shown) arranged in housing 5, pipe 3 is retained in its lifted position until the water in flush tank 2 has reached a lower level, whereupon the valve plate again seals the drain opening.

The invention relates in particular to the arrangement for lifting pipe 3. The latter has a socket 7 which encloses bonnet 6 of the flush valve attached on housing 5. Socket 7 is unitary with a generally hemispherical laterally arranged bell 7*a* having an upper cylindrical flange 7*b*. A plastic nipple 8 for plastic hose 9 is attached to the lower end of bell 7*a*, and the hose is connected with a manual pusher (see FIGS. 2 and 3). Arranged within bell 7*a* is an also hemispherical rubber membrane having an outer flange 10*a* which rests on a ledge 7*c* of bell 7*a* and is held in place by a guide ring 11. Guide ring 11 is itself pressed down by the border 12*a* of a guide casing 12 which is screwed into cylindrical flange 7*a*.

Within guide casing 12 is an axially displaceable cylindrical piston 13*a* whose lower, arcuate face rests on the inner surface of membrane 10. Piston 13*a* forms part of a hood 13 which, with some clearance, overlaps bell 7*a*. A clamping ring 13*b* arranged on and integral with hood 13 engages a groove in an annular member 14 connected to pipe 3. Hood 13 is closed by a cover 15. The entire actuating element, except for membrane 10, is made of synthetic material, e.g., PVC. Membrane 10 can be made of rubber or a rubber-synthetic mixture.

Figure 2:
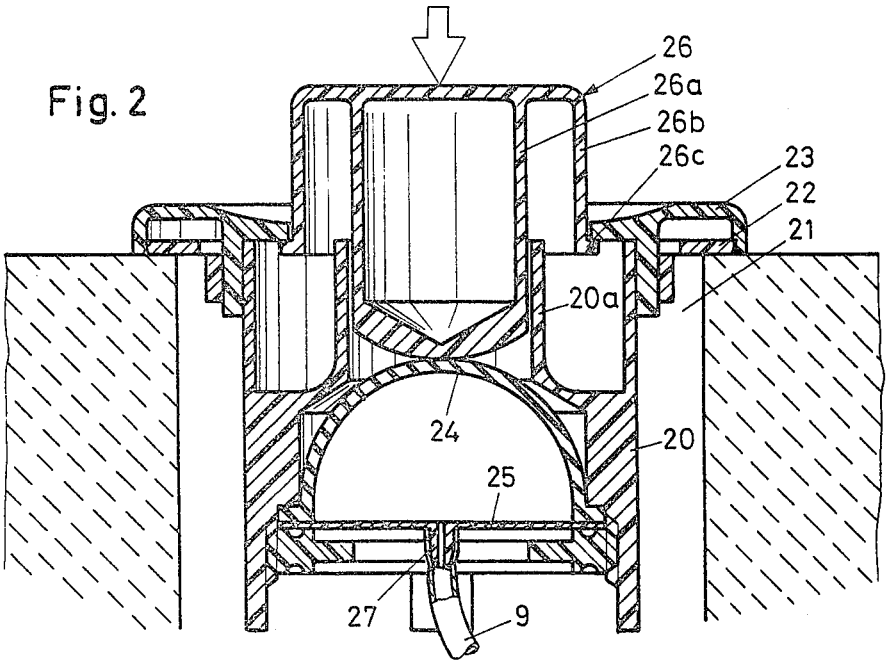
FIG. 2 is a longitudinal section view of a manual pusher for actuating the flush valve.

The embodiment of the manual pusher shown in FIG. 2 comprises a housing 20 inserted in a wall opening 21 covered by a base plate 22. Attached to base plate 22 is a cover plate 23 which is removably inserted into housing 20. A hemispherical eleastic membrane 24, whose hollow space is closed by a floor 25 having a nipple connection 27, is emplaced in housing 20. Tubing 9, which is connected to nipple 8, is attached to nipple 27. A plug-shaped portion 26*a* of a push button 26 is displaceably guided in a cylindrical guide portion 20*a* of housing 20. An outward flange 26*c* of a sheath portion 26*b* of push button 26 dovetails with cover plate 23. By means of elastic membrane 24, push button 26 is biased to the illustrated position.

In order to actuate the toilet flush valve, push buttom 26 is pushed inwardly in the direction of the arrow. This causes membrane 24 to buckle and the displaced air to flow through hose 9 into bell 7*a*, where it deforms membrane 10. This causes lifting of piston 13*a* with hood 13. Pipe 3 connected to hood 13 is also lifted and valve plate 4 frees the drain opening.

Figure 3:
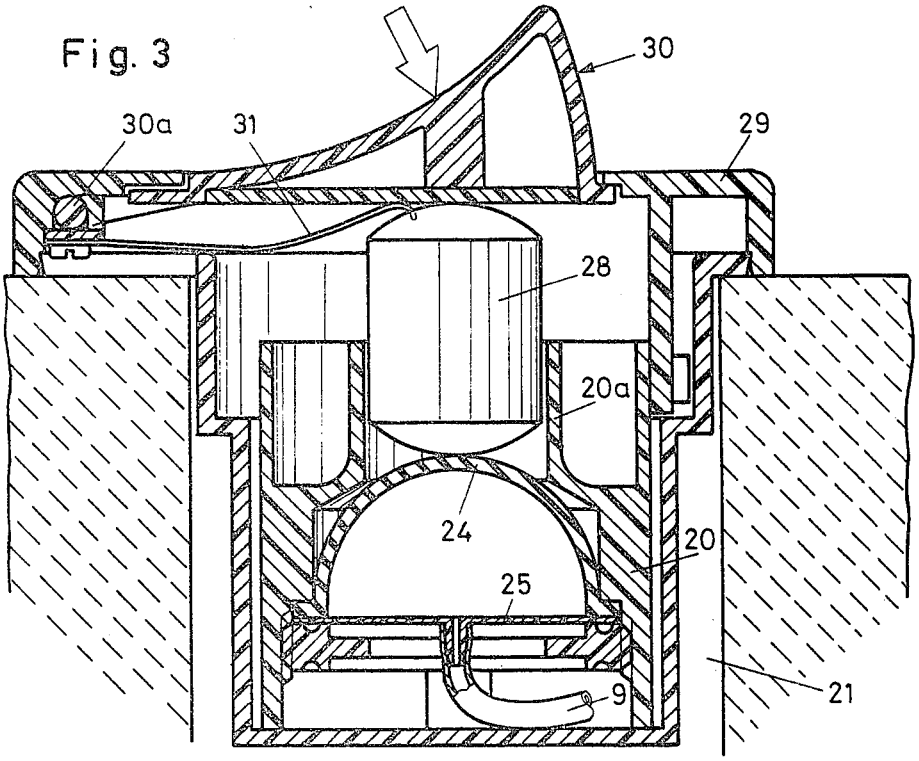
FIG. 3 is a longitudinal section view of a modified manual pusher.

The embodiment according to FIG. 3 comprises the same housing 20 with membrane 24 as the FIG. 2 embodiment. In place of push button 26, a cylindrical plug 28 with arcuate ends is inserted in guide portion 20*a*. A push plate 30 is swingably mounted on cover plate 29 by means of a pivot pin 30*a*. Push plate 30 is biased to the illustrated position by means of leaf springs 31. Upon actuation of push plate 30 in the direction of the arrow, membrane 24 is deformed by plug 28 in the same manner as in the FIG. 2 embodiment.

In connection with the pushers according to FIGS. 2 and 3, floor 25 with nipple connection 27 could be formed differently. In place of a relatively thin floor with a vertical, rearwardly divergent nipple 27, a thicker floor could be provided, with a radial, outwardly directed bore terminating in a nipple for hose 9 which projects laterally from the housing.

What is claimed is:

1. Pneumatic actuating device for a flush valve, said device having actuating means for attachment to a valve housing and pusher means connected to said valve housing by conduit means, said actuating means comprising (a) a socket for placement upon said valve housing and integral with a lateral hemispherical bell member;

(b) a hemispherical membrane secured within said bell member by the edge portion of a guide casing;

(c) said bell member having a wall portion comprising connecting means for said conduit means;

(d) a cylindrical piston being mounted for axial sliding movement within said guide casing, one end of said piston abutting the inner surface of said membrane, said piston having a portion projecting from said guide casing, said projecting portion carrying a retaining means for connection to a pipe to which is attached a valve plate of said flush valve.

2. Pneumatic actuating device according to claim 1, wherein said pusher has a housing containing a hemispherical membrane having a hollow interior closed off by a floor, said floor having a connecting nipple for said conduit means, said actuating device further comprising a plug-shaped portion of said push button guided in a guide portion of said housing, an end face of said plug-shaped portion abutting the outer surface of said membrane.

3. Pneumatic actuating device according to claim 1, wherein said piston is connected with a hood overlapping said lateral bell, a clamping ring for attaching said pipe being arranged on said hood.

4. Pneumatic actuating device according to claim 2, comprising a push plate swingably mounted on a cover plate and actuating a plug slidably mounted in said guide portion of said housing.

* * * * *